United States Patent [19]

Buck et al.

[11] Patent Number: 4,689,204

[45] Date of Patent: Aug. 25, 1987

[54] MULTIPLE STEP REAGENT DELIVERY SYSTEM

[75] Inventors: Gerald F. Buck, Sherborn; John W. Roberts, Milford; Steven Sable, Franklin, all of Mass.

[73] Assignee: Cambridge BioScience Corporation, Worcester, Mass.

[21] Appl. No.: 709,595

[22] Filed: Mar. 8, 1985

[51] Int. Cl.[4] ..... B01L 3/02

[52] U.S. Cl. ..... 422/100; 73/863; 222/135; 422/101; 422/104; 422/61

[58] Field of Search ..... 73/863.01, 863.11, 863.12, 73/863.13, 864.17, 864.18, 863.32, 863.33; 422/61, 100, 101, 104; 222/135, 137

[56] References Cited

U.S. PATENT DOCUMENTS

| | | | |
|---|---|---|---|
| 2,077,898 | 4/1937 | Rolff | 222/135 |
| 3,444,742 | 5/1969 | Ellis et al. | 73/863.32 |
| 3,642,175 | 2/1972 | Robbins | 222/135 |
| 3,985,032 | 10/1976 | Avakian | 73/864.01 |
| 4,096,972 | 6/1978 | Bartels et al. | 222/135 |
| 4,483,825 | 11/1984 | Fatches | 422/101 |

FOREIGN PATENT DOCUMENTS

| | | | |
|---|---|---|---|
| 3025869 | 1/1982 | Fed. Rep. of Germany . | |
| 55-84876 | 6/1980 | Japan | 222/137 |

*Primary Examiner*—Michael S. Marcus

*Attorney, Agent, or Firm*—Bromberg, Sunstein & Casselman

[57] ABSTRACT

The present invention relates to devices for delivering reagents for tests, and particularly for assays applicable to biological fluids.

21 Claims, 8 Drawing Figures

MULTIPLE STEP REAGENT DELIVERY SYSTEM

BACKGROUND ART

Numerous devices have been developed for dispensing fluids for test purposes. U.S. Pat. No. 3,749,084, issued for an invention of Cucchiara, discloses a syringe having concentric chambers and concentric pistons for dispensing from or filling the chambers independently. However, the device disclosed involves complicated manufacturing techniques, and does not provide a system for incubation or processing of the pertinent biological fluids.

U.S. Pat. No. 3,978,846, issued for an invention of Bailey, discloses a multiple chamber device for taking blood samples. However, the device includes a valve that would prevent its use in dispensing reagents, and does not include a system for processing of any reagents.

DISCLOSURE OF INVENTION

The present invention provides a multiple-step reagent delivery system which is suitable for use in conducting rapid analysis of water and biological fluids. The system includes a processing tube having a fluid path running through it, a plurality of non-concentric chambers for holding reagents, with each chamber being in communication with the processing tube. Each chamber is equipped with an arrangement for dispensing reagent from the chamber into the processing tube, and the system includes an arrangement for activating in a predetermined sequence the dispensing arrangement in each chamber so as to cause reagent in each chamber sequentially to flow through the processing tube. The invention also provides a workstation which may utilize one or more of these systems and which permits simultaneous testing of a plurality of specimens.

BRIEF DESCRIPTION OF THE DRAWINGS

These and other features of the invention will be more readily understood by consideration of the following detailed description taken with the accompanying drawings in which.

DESCRIPTION OF SPECIFIC EMBODIMENTS

Figure 1:
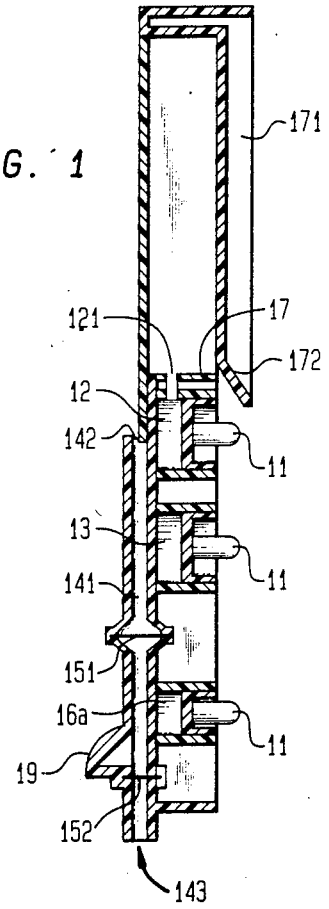
FIG. 1 is a longitudinal section of a preferred embodiment of the invention.

FIG. 1 shows a preferred embodiment of the present invention. A plurality of chambers, such as 12, 13, and 16A are shown here in communication with a processing tube 141. A biological fluid or other specimen, such as urine may be loaded into the chamber 12, via specimen filling port 121. (As used in this description and the claims, any fluids or other substances that are placed in the chambers are sometimes referred to as "reagents".)

Figure 3:
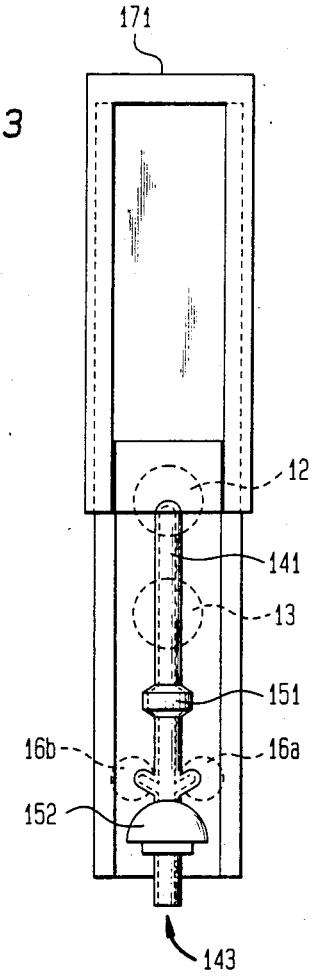
FIG. 3 shows a side elevation of the embodiment of FIG. 1 from a view at right angles to the plane through which the section of FIG. 1 is taken.
Figure 4:
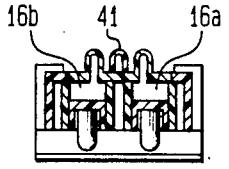
FIG. 4 shows a cross section of the embodiment of FIG. 1.

Reagents may be preloaded in chambers 13 and **16*a*. Another chamber, 16*b* (which is shown in FIG. 3 and 4) is here out of view, and may also be preloaded with a reagent. Each chamber is fitted with a piston member having a dispensing member 11 attached thereto. As can be seen, motion of the dispensing member 11 to the left toward the processing tube causes dispensing of the reagent therein into the beginning 142 of the processing tube. The filling port 121 is early in the despensing sequence covered by its chamber's piston member so that positive air pressure within the chamber forces its contents into the processing tube. Each of the chambers 13, 16*a*, and 16*b* may be provided with a pressure sensitive septum to create a temporary seal adjacent its exit port to prevent reagent from being dispensed therefrom until after the dispensing member 11 for such chamber is pushed. Alternatively the septum may be pierced by a suitable barb placed on the piston member, which on displacement thereof, opens the exit port. Once the filling port 121 is covered by its chamber's piston member, the contents of the processing tube are under pressure, which may assist in moving the material in the processing tube through the system. Below the port through which fluid flows from chamber 13 into the processing tube 141 there is located a course filter 151 in the flow path for removing large particles that would otherwise interfere with proper testing. Near the end 143 of the processing tube 141 is located a fine filter 152, which permits fluid flow but inhibits flow of bacteria or other desired analyte(s). In appropriate circumstances the filter may be chemically active, rather than or in addition to, a physical filter. In operation, the case 17 of the system is provided with an activation member 171** which is mounted to slide longitudinally along the system, parallel to the processing tube.

Figure 2A:
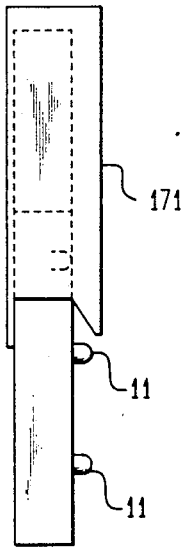
FIGS. 2A through 2C illustrate operation of the activation member 171 in FIG. 1 in sequential dispensing of reagents in the system.
Figure 2B:
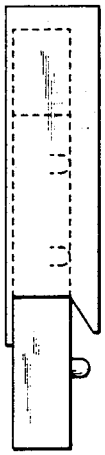
Figure 2C:
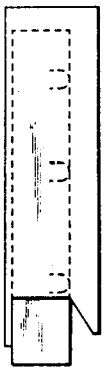

The progressive motion of the activation member 171 is shown in FIG. 2A through 2C. As can be seen from the figure, the beveled edge 172 of the activation member shown in FIG. 1 engages against the dispensing member 11 of each chamber and causes the member to be pushed to the left, thereby dispensing reagent into the processing tube. In this manner, first the urine or other specimen in chamber 12 enters the processing tube, followed sequentially by the contents of the chamber 13 (which may include, for example, a wash or buffer solution), whereupon the partially processed specimen, after passing through the course filter 151, can then react with reagents that are expressed from chambers **16*a* and 16*b***.

In one application for the invention, bacteria in urine may be detected by suitable chemistry, since the bacteria can be trapped and concentrated by the fine filter 152. Magnifying lens 19 may be integrally formed with the case 17, and assists in observing the color of the surface of the fine filter 152. Since the points in time at which fluids are dispensed from the respective chambers may be controlled precisely by determining the specified times at which the activation member is caused to slide down the case 17, any desired testing cycle and be accommodated.

FIG. 3 shows a side elevation taken at right angles to the longitudinal section of FIG. 1 of the embodiment of FIG. 1. In phantom are shown the chambers 12, 13, **16*a*, and 16*b*. There can also be seen the processing tube 141 and the region for the course filter 151 and fine filter 152. Chambers 16*a* and 16*b* occur at the same point along the flow path through the processing tube 141, and are expressed at the same time by the dispensing member 171**.

FIG. 4 shows more clearly the geometry of the system in this connection, where the system is shown in cross section. Chambers 16*a* and 16*b* are shown as side by side. There can also be seen the dispensing member shown here as item 41 associated with chamber 13.

Figure 5:
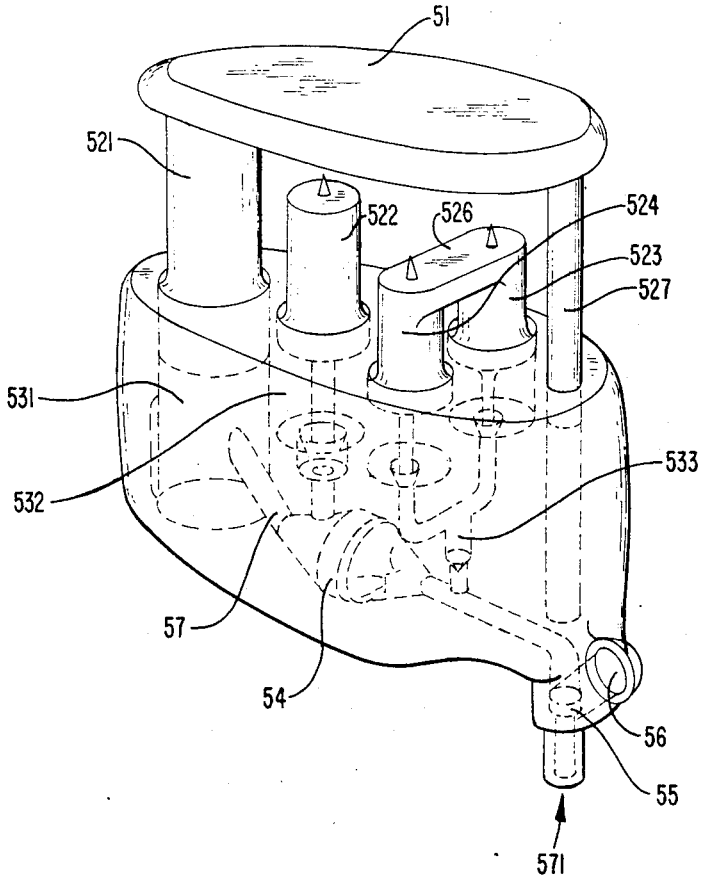
FIG. 5 shows another embodiment of a system in accordance with the present invention.

FIG. 5 shows another embodiment of the present invention. In this embodiment, an activation member 51 pushes the dispensing member associated with each chamber. The specimen may be put in chamber 531, with the buffer or wash in chamber 532, and additional reagents in chambers associated with dispensing members 523 and 524, which are here linked with yoke 526. In this embodiment the dispensing member 521 is the tallest of the dispensing members that may be contacted by activation member 51, and in fact dispensing member 521 is preferrably attached to the activation member 51 and serves as a guide for it. In general the sequence of dispensing is here governed by the amount of gap, if any, between each dispensing member and the activation member. The larger the gap, the later the activation in sequence. The gap may also be varied by suitable amendment of the shape of the activation member. A guide 527 is specifically provided at the other end of the system for the plate. The dispensing member 522 is somewhat shorter than the member 521 but is still taller than the height of yoke 526 linking dispensing members 523 and 524. In this fashion, as the activation member 51 is lowered, the contents of chamber 531 are first emptied to the processing tube 57, followed by the contents of chamber 532, and thereafter by the contents simultaneously of the chambers associated with dispensing members 523 and 524. The latter two chambers are emptied via union 533 into the processing tube 57. As in the previous embodiment, flow from the processing tube starts at chamber 531 and continues through the course filter 54 and the fine filter 55 to the end of the processing tube 571. The embodiment may be provided with an integrally formed lens 56 for viewing the condition of the fine filter.

Figure 6:
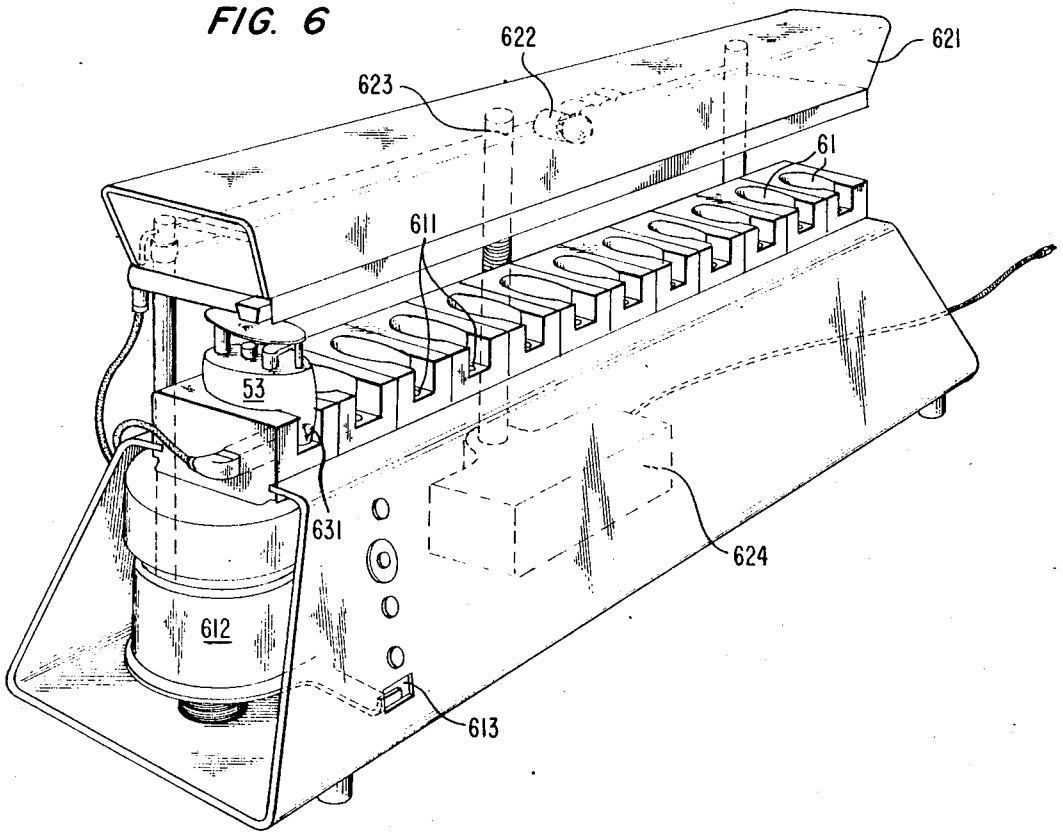
FIG. 6 shows a workstation capable of operating on a plurality of the systems in accordance with the embodiment of FIG. 5.

The embodiments of either FIG. 1 or FIG. 5 may be placed in a suitable workstation, although for convenience of illustration, FIG. 6 presents a workstation designed for the embodiment of FIG. 5. The workstation includes a plurality of receiving shoes 61, each receiving a system 63, such as shown in FIG. 5. Each receiving shoe contains a drain 611 which communicates with the drain reservoir 612.

The workstation also includes an activation bar 621 that comes into contact with the activation member of each system in the workstation. (If the workstation is equipped to receive systems in accordance with the embodiment of FIG. 1, the activation member 171 need not necessarily be used, as a suitable activation arrangement may be devised to contact directly each of the dispensing members 11. Such an arrangement may include a plurality of activation members each acting on corresponding dispensing members, of each system.) The height of this bar is controlled by a motor driven screw feed 623 so that the timing of the dispensing of specimen and reagent from each chamber in the system may be carefully controlled. The lens 631 (shown as item 56 in FIG. 5) is placed in each system 63 in such a way that it may be readily viewed without removal of the system unit from the workstation. Light to facilitate viewing color development on the surface of the fine filter in connection with a given test may be provided by a suitable source 622. It may in some embodiments be desirable to use a light pipe to deliver light to the vicinity of each fine filter in each system to enhance viewing the surface thereof. When the reservoir 612 is full, a spring-loaded indicator can indicate the status on the front of the workstation. The workstation is similarly provided with a motor system 624 to drive the feed screw 623, as well as suitable timing and indicator devices on panel 64. Because each system in each receiving shoe has a positive pressure in its processing tube, a clogged filter, for example, could cause the system to jam. In such a case, the workstation may be fitted with a means for releasing a given system in the array of systems from further processing if its activation member or dispensing mambers are not displaced in the presence of a predetermined amount of force.

Accordingly, while the invention has been described with particular reference to specific embodiments thereof, it will be understood that it may be embodied in a variety of forms diverse from those shown and described without departing from the spirit and scope of the invention is defined by the following claims.

What is claimed is:

1. A multiple-step reagent delivery system, comprising:

a processing tube having a fluid path therethrough;

a plurality of non-concentric chambers for holding reagents, each chamber in communication with the processing tube;

dispensing means, included in each chamber, for dispensing fluid in such chamber into the processing tube, such dispensing means including a movable dispensing member having a linear direction of travel along a dispensing axis, motion of which dispensing member causes dispensing of fluid in the chamber and wherein the dispensing axes of the dispensing members are generally parallel to one another;

activation means for activating the dispensing means in each chamber, such activation means including an activation member movable in a predetermined linear direction for moving in a fixed sequence the dispensing member of each chamber so as to cause a single discharge of the total fluid content of each chamber sequentially into the processing tube.

2. A system according to claim 1, further comprising:

a filter, disposed in the fluid path of the processing tube.

3. A system according to claim 2, wherein the filter is a coarse filter disposed in the fluid path after a point, of communication of at least one of said plurality of chambers with the processing tube and before another point of communication of another chamber of said plurality of chambers with the processing tube.

4. A system according to claim 3, futher comprising a fine filter filter disposed in the fluid path after a point of communication of each of the chambers with the processing tube.

5. A system according to claim 4, wherein (i) the processing tube is generally straight and has a longitudinal axis and (ii) the dispensing axes are approximately perpendicular to a plane of the longitudinal axis of the processing tube.

6. A system according to claim 5, wherein the activation member is slidably mounted to the system along a path generally parallel to the longitudinal axis of the processing tube and transverse to the dispensing axes, and having a region along the path that is in contact with each dispensing member, the region being so shaped and the activation member being so oriented that, as the activation member is slided along the path, each dispensing member is sequentially displaced along its dispensing axis and thus the reagent in the chamber associated with such dispensing member is dispensed in sequence.

7. A system, according to claim 6, wherein said plurality of chambers comprises:

a first chamber for holding a specimen; a second chamber for holding a first reagent; and third and fourth chambers for holding second and third reagents respectively;

wherein the first chamber is disposed at the beginning of the fluid path through the processing tube, and the fine filter is disposed at the end of the fluid path, with the second chamber next disposed along the fluid path after the beginning thereof, followed by the coarse filter, in turn followed by a junction having communication to both the third and fourth chambers.

8. A system according to claim 2, wherein the filter is a fine filter disposed in the fluid path after a point of communication of each of the chambers with the processing tube.

9. A system according to claim 8, further comprising a housing, said reagent delivery system enclosed in said housing, and a magnifying lens for viewing the surface of the fine filter, attached to the housing proximate to the fine filter.

10. A system according to claim 9, wherein the lens integrally formed in the housing.

11. A system according to claim 2, wherein (i) the procesing tube is generally straight and has a longitudinal axis and (ii) the dispensing axes are approximately perpendicular to a plane of longitudinal axis of the processing tube.

12. A system according to claim 1, wherein (i) the processing tube is generally straight and has a longitudinal axis and (ii) the dispensing axes are approximately perpendicular to a plane of the longitudinal axis of the processing tube.

13. A system according to claim 12, wherein the activation member is slidably mounted to the system along a path generally parallel to the longitudinal axis of the processing tube and transverse to the dispensing axes, and having a region along the path that is in contact with each dispensing member.

14. A multiple-step reagent delivery system, comprising:

a processing tube having a fluid path therethrough;

a plurality of non-concentric chambers for holding reagents, each chamber in communication with the processing tube;

dispensing means, included in each chamber, for dispensing fluid in such chamber into the processing tube, such dispensing means including a movable dispensing member having a linear direction of travel along a dispensing axis, motion of which dispensing member causes dispensing of fluid in the chamber and wherein each dispensing member has an end;

activation means for activating the dispensing means in each chamber, such activation means including an activation member having a direction of motion parallel to the dispensing axes and a starting position, and disposed so as to contact the end of each dispensing member when the activation member is displaced from the starting position, the sequence of activation of each dispensing member being determined by the amount of gap, if any, between the end of each dispensing member and the activation member when in the starting position.

15. A system according to claim 14, further including: a fine filter, disposed in the fluid path of the processing tube.

16. A system according to claim 15, wherein the filter is a coarse filter disposed in the fluid path, after a point of communication of at least one of said plurality of chambers with the processing tube and before another point of communication another chamber of said plurality of chambers with the processing tube and further comprising a fine filter disposed in the fluid path after a point of communication of each of the chambers with the processing tube.

17. A system according to claim 16, wherein said plurality of chambers comprises:

a first chamber for holding a specimen; a second chamber for holding a first reagent; and third and fourth chambers for holding second and third reagent respectively;

wherein the first chamber is disposed at the beginning of the fluid path through the processing tube, and the fine filter is disposed at the end of the fluid path, with the second chamber next disposed along the fluid path after the beginning thereof, followed by the coarse filter, in turn followed by a junction having communication to both the third and fourth chambers.

18. A workstation for a plurality of multiple step reagent delivery systems, the workstation comprising:

a frame;

receiving means, affixed to the frame, for removably receiving a plurality of distinct multiple-step reagent delivery systems, each system including a processing tube;

a plurality of non-concentric chambers for holding reagents, each chamber in communication with the processing tube; and dispensing means included in each chamber, for dispensing fluid in such chamber into the processing tube; and processing means for activating, for each system which has been placed in the receiving means, the dispensing means in each chamber thereof in a predetermined sequence.

19. A workstation according to claim 18, wherein (i) the processing tube of each system is generally straight and has a longitudinal axis; (ii) the dispensing means in each chamber includes a movable dispensing member having a linear direction of travel along a dispensing axis; and (iii) the dispensing axes of the dispensing members are generally parallel to one another.

20. A workstation according to claim 18, wherein the processing means includes means for activating simultaneously the dispensing means in corresponding chambers in each system which has been placed in the receiving means.

21. A workstation for a multiple step reagent delivery system, the workstation comprising:

a frame;

receiving means, affixed to the frame, for removably receiving a multiple step reagent delivery systems, the system including a processing tube;

a plurality of non-concentric chambers for holding reagents, each chamber in communication with the processing tube; and dispensing means included in each chamber, for dispensing fluid in such chamber into the processing tube; and processing means for activating the dispensing means in each chamber of the system in a predetermined sequence.

* * * * *